United States Patent [19]

Martz et al.

[11] 4,011,735

[45] Mar. 15, 1977

[54] BLOWER SYSTEM AND CONTROL SYSTEM THEREFOR

[75] Inventors: Lyle F. Martz, Verona; John W. Nanz, Pittsburgh, both of Pa.

[73] Assignee: Westinghouse Electric Corporation, Pittsburgh, Pa.

[22] Filed: Nov. 29, 1974

[21] Appl. No.: 528,590

Related U.S. Application Data

[63] Continuation of Ser. No. 420,483, Nov. 30, 1973, abandoned, and a continuation of Ser. No. 359,398, May 11, 1973, abandoned, which is a continuation of Ser. No. 265,385, June 22, 1972, abandoned.

[52] U.S. Cl. ..... 62/186; 165/31

[51] Int. Cl.[2] ..... F24F 3/02

[58] Field of Search ..... 62/186; 165/31, 16; 236/13, 14, 1, 49; 98/33 R

[56] References Cited

UNITED STATES PATENTS

| | | | |
|---|---|---|---|
| 1,166,758 | 1/1916 | Gibson | 236/14 |
| 1,338,928 | 5/1920 | Hopwood | 236/14 |
| 2,282,210 | 5/1942 | Plum | 165/31 |
| 2,696,715 | 12/1954 | Lehane | 62/186 |
| 2,710,724 | 6/1955 | McMahon | 165/31 |
| 2,747,842 | 5/1956 | Shataloff | 165/31 |
| 3,465,962 | 9/1969 | Matulick | 236/13 |
| 3,584,785 | 6/1971 | Matulick | 165/31 |
| 3,687,364 | 8/1972 | McNabney | 236/49 |
| 3,690,548 | 9/1972 | McNabney | 236/1 |

FOREIGN PATENTS OR APPLICATIONS

| | | | |
|---|---|---|---|
| 344,914 | 3/1931 | United Kingdom | 98/33 A |

*Primary Examiner*—William E. Wayner
*Attorney, Agent, or Firm*—E. F. Possessky

[57] ABSTRACT

An automatic control system for high pressure blower applications prevents surging under variable supply flow rate requirements and achieves maximum efficiency of operation. The supply flow rate establishes the set point of a proportional plus reset controller, the latter receiving a feedback signal corresponding to the static discharge pressure of the supply blower and responding thereto for controlling the output of the supply blower. A return blower is controlled either through a characterizer relay in proportion to the control of the supply blower to maintain a fixed precalibrated relationship between supply and return flow rates or by a further proportional plus reset controller responsive to the supply flow rate, for establishing the set point thereof, and to the return flow rate, as a feedback signal thereto, for controlling the output of the return blower.

7 Claims, 2 Drawing Figures

A. C./ HEAT
FLOW RATE TRANSMITTER
FLOW RATE SENSOR
DUCT PRESSURE TRANSMITTER
STATIC DUCT PRESSURE SENSOR
PROPORTIONAL RESET CONTROLLER
MANUAL AUTOMATIC CONTROL STATION
POSITIONER
FLOW RATE SENSOR
FLOW RATE TRANSMITTER
PROPORTIONAL RESET CONTROLLER
MANUAL AUTOMATIC CONTROL STATION
POSITIONER
POSITIONER
10
12
14
16
18
20
22
22a
22b
22c
22d
22e
22f
24
26
28
30
32
34
36
40
42
44
46
50
52
54
56
60
62
64
66
68
72
74
76
78
80
82
84
86
88
90
92

POSITIONER
MANUAL AUTOMATIC CONTROL STATION
CHARACTERIZER RELAY
PROPORTIONAL RESET CONTROLLER
FLOW RATE TRANSMITTER
FLOW RATE SENSOR
DUCT PRESSURE TRANSMITTER
STATIC DUCT PRESSURE SENSOR
MANUAL AUTOMATIC CONTROL STATION
POSITIONER
A. C./ HEAT
POSITIONER
36'
32'
30'
34'
28'
26'
22'
20'
18'
66'
68'
64'
74'
62'
60'
72'
76'
78'
80'
56'
10'
12'
14'
40'
42'
44'
90'
96
94
50'
52'
54'
92'

BLOWER SYSTEM AND CONTROL SYSTEM THEREFOR

This application is a continuation of application Ser. No. 420,483 filed 11/30/73, now abandoned, a continuation of application Ser. No. 359,398 filed 5/11/73, now abandoned, which is a continuation of application Ser. No. 265,385, filed 6/22/72,, now abandoned.

BACKGROUND OF THE INVENTION

Field of the Invention

This invention relates to blower systems and blower control systems and, more particularly, to such systems for use in a ventilating installation for preventing surging while maintaining maximum efficiency of operation.

State of the Prior Art

Central air conditioning or ventilating installations, i.e., for both cooling and heating of air, as utilized in large buildings such as schools, office buildings and factories, typically utilize a central supply blower which is required to operate at a relatively high discharge pressure. Three inches to 30 inches of water are required to maintain an adequate flow rate of the air through the ventilating, i.e., air conditioning or heating, apparatus and ultimately through an arrangement of headers and dampers for distribution to the various individual rooms of the building supplied by the installations. As is also typical, a return is provided for exhausting air from the rooms and returning the thus exhausted air, usually mixed with a percentage of fresh air, through the air conditioning system to be recirculated.

A problem frequently encountered in such installations is known as surging. Very briefly, surging occurs when the supply flow rate diminishes but the discharge pressure remains relatively high. When this situation obtains, the supply blower stalls, in an aerodynamic sense, until the discharge pressure is reduced, at which time the supply blower again begins to generate a supply flow. If the required supply flow rate remains low, however, the discharge pressure again increases causing stalling to occur again. Unless controls are provided, the stalling repeats in a periodic manner until the system flow rate requirements increase. Numerous deleterious effects obtain from this surging condition. The resulting overloads on the blower, both as to the fan unit and the driving motor therefor, can destroy it. In addition, the periodic surging in the supply ducts which receive the discharge of the blower causes an undesirable bulging of the ducts with resultant, objectionable popping sounds, and may in fact destroy the ducts or substantially reduce their useful life.

SUMMARY OF THE INVENTION

The present invention overcomes these and problems of prior art ventilation systems, and other such systems utilizing high pressure blowers, and achieves maximum efficiency in operation.

In accordance with a first embodiment of the invention, means are provided for sensing the air supply flow rate and the static duct pressure in the main duct receiving the discharge of the supply blower. A control system, preferably including a proportional plus reset controller, responds to the supply flow rate to establish a set point for its control function. The control system further responds to the static duct pressure as a feedback signal which is compared to the set point signal and it generates an output control signal for automatically controlling the output air flow from the supply blower. The output control signal adjusts the output flow of the supply blower in accordance with the varying air requirements of the installation, and correspondingly maintains the blower discharge pressure at a value functionally related to the supply flow rate such that surging is prevented while maximum efficiency is attained.

The supply flow of air then typically passes through a conditioning system, e.g. for heating or cooling, and then through a header for distribution to the various rooms to be services. A return blower operates to exhaust the air from the rooms thus supplied, and return the air typically mixed with a predetermined proportion of fresh air to the supply blower, in a continuing cycle.

In accordance with a first embodiment of the invention, the control system includes a further proportional plus reset controller associated with the return system to respond to the supply flow rate and establish a set point of operation with the return fan flow rate as a feedback signal. An output control signal is generated to adjust the output of the return blower and achieve a desired relationship of the return and supply flow rates. In accordance with a second embodiment of the invention, the return blower is controlled through a characterization function, preferably by marks of a characterizer relay, in response to the proportional plus reset control output for the supply system, thereby to maintain a fixed precalibrated relationship between the return and supply systems.

The system of the invention is highly effective in operation, positively preventing surging while assuring supply flow rates under varying demands and affording maximum efficiency of operation. As specifically disclosed herein, the system is preferably implemented through use of pneumatic sensing, transmitting, and control components to be of relatively simplified form, thereby affording low cost of installation and simplified maintenance. However, the invention may be embodied with electronic digital and/or analog elements in a digital computer or other electronic control system.

BRIEF DESCRIPTION OF THE DRAWINGS

In FIG. 1, a supply blower 10 is shown diagrammatically to include a fan-like element 12, driven through a pulley and belt arrangement from an electric motor 14, and a system of movable louvers 16. Duct 18 receives the discharge or output of the supply blower 10 and conveys that output to an air conditioning system 20, which may be for cooling and/or heating of the air supplied to it. A facility or building 22 serviced by the system is shown to include a plurality of individual rooms 22a through 22f each of which receives an individual supply of the conditioned air by distribution through a header system 24. With reference only to the system as illustrated for the room 22a, since the others are identical, a duct 26 conveys the air from the header 24 and through a damper 28 to the interior of the room. A thermostat 30 responds to the temperature conditions obtaining in the room to automatically adjust the damper 28 to obtain a desired rate of supply of air to the room 22a. The spent air in the room is exhausted through a ventilator 32 associated with a return header 34, and is supplied by duct 36 to the return blower 40.

Figure 1:
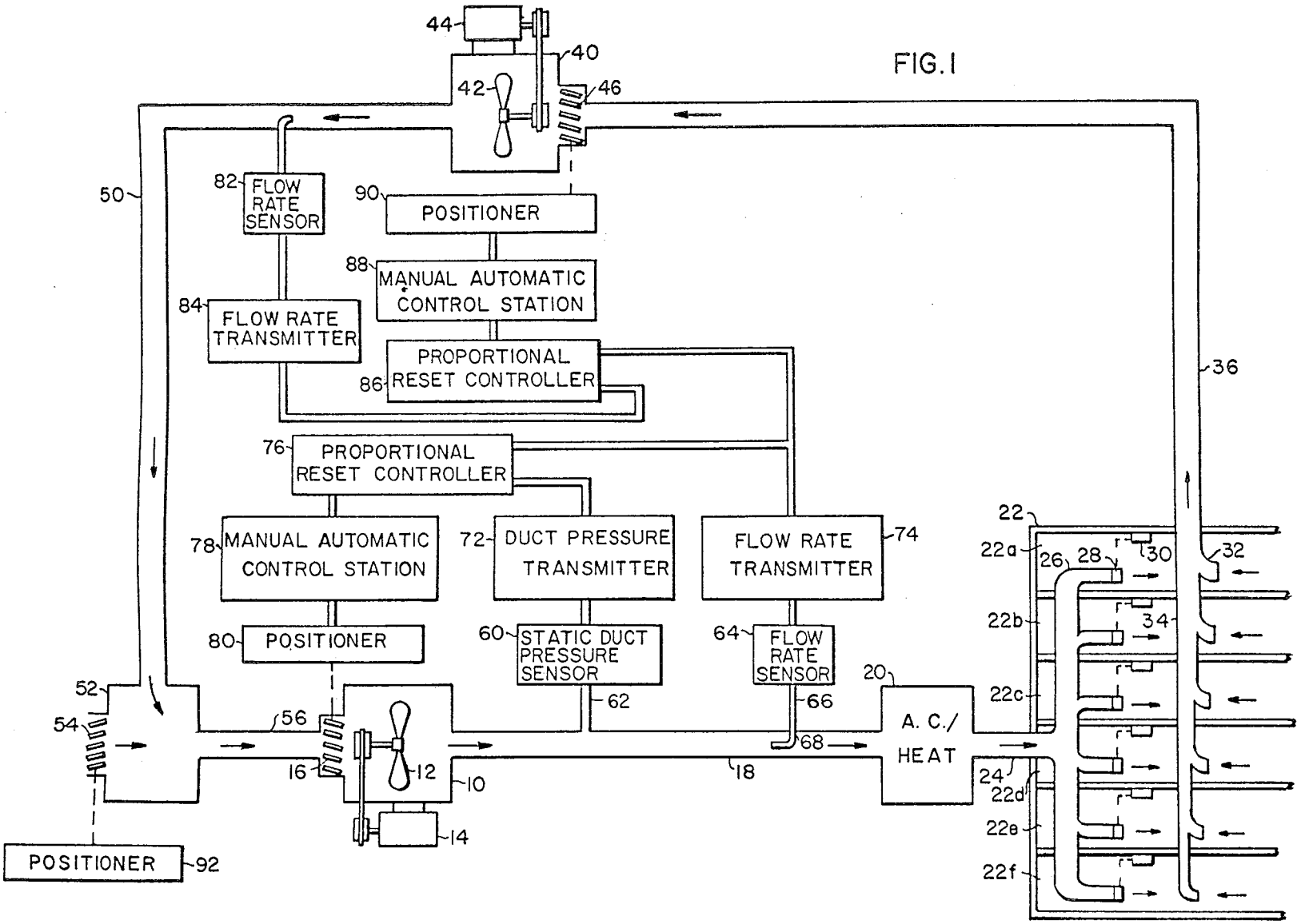
FIG. 1 comprises a block diagram of a first embodiment of the system of the invention.

The facility 22, in a practical application, will typically include many more separate rooms than are illustrated herein; in fact, it is to be appreciated that the system of the invention is for use with relatively large installations imposing very high supply rate requirements for attaining the necessary cooling and/or heating effects. It will also be understood that whereas, for simplicity and clarity of presentation, only a single header and distribution system are shown, separate duct work for cooling and for heating may be provided for servicing each of the individual rooms. In that event, separate dampers or other controls such as a combination of dampers and baffles may be provided to permit the necessary selective control of the temperature conditions. It likewise will be appreciated that the invention may be applied to any ventilating system using high pressure blowers, and thus is not limited to use with only air conditioning and heating systems.

The return blower 40 may be similar to the supply blower and thus includes adjustable louvers 46 and a fanlike element 42 driven through a belt and pulley system from an electric motor 44. The return blower 40 creates a return flow, as indicated by the arrows through the duct 36, which proceeds from the blower 40 through the duct 50 to a chamber 52 where the entry of a desired amount of fresh air is permitted through adjustable louvers 54 and duct 56 to the supply blower 10.

A sensor 60 communicates through conduit 62 with the interior of duct 18 for measuring the static pressure within the duct. A further sensor 64 communicates through conduit 66 associated with a pitot tube 68 to respond to the supply air flow rate within the duct 18. The sensor 64 may therefore include a connection similar to that associated with conduit 62 to the duct 18, to produce a pressure differential signal proportional to the supply flow rate.

The static pressure measured by sensor 60 from the duct 18 corresponds substantially identically to the discharge pressure or plenum chamber pressure produced by the supply blower 10, since the portion of the system from the blower 10 to the air conditioning/heating unit 20 is closed. This pressure, in a typical system, ranges from 1 inch to 30 inches W.C. It will be appreciated that any of various suitable devices may be utilized to measure the static pressure, as well as the flow rate, as represented by the sensors 60 and 64, respectively.

Duct pressure and flow rate transmitters 72 and 74 receive the output of their associated sensors and transmit corresponding signals preferably to a proportional plus reset controller 76. Each of the transmitters 72 and 74 is a commercially available unit, capable of adjustably responding to the relatively weak pressure representative signals produced by its associated sensor and producing a corresponding output signal of substantially increased strength. An example of such a transmitter is known as the D-33 Head Ratio Totalizer, manufactured by Westinghouse Electric Corporation, the assignee herein. Thus, the output signals of transmitters 72 and 74 can be adjusted for calibration purposes.

Furthermore, as in the present invention, the output of transmitters 72 and 74 can be tuned with respect to one another so that for a particular system a predetermined relationship between the supply flow rate and the discharge pressure of supply blower 10 can be readily established.

The proportional reset controller 76 is a pneumatically operated force-balance device and in the particular application herein responds to the pneumatic input signals from the transmitters 72 and 74 to convert these into a single pneumatic output signal. In particular, the pressure differential signal from the flow rate transmitter 74 is supplied to the controller 76 as a set point signal and the duct pressure signal from transmitter 72 is supplied as a feedback signal to the controller 76. In response thereto, the controller 76 produces a pneumatic output signal which is proportionately and integrally related, as desired, to the difference between the feedback and set point signals. The proportional plus reset controller 76 is likewise a commercially available unit and as an example thereof, such a unit is manufactured by Westinghouse Electric Corporation and known as the Hagan Ratio Totalizer.

The pneumatic output signal of the controller 76 then is supplied to a manual-automatic control station 78, the output of which is supplied to a positioner 80; each of these units likewise comprises a commercially available unit and may be the types manufactured by Westinghouse Electric Corporation.

The control station 78 is utilized intermediate the primary controller 76 and the final control unit, herein the positioner 80, to permit selection of either manual or automatic control of the latter, and thus of the final, controlled element — in this instance, the louvers 16. The mechanical positioning of those louvers is diagrammatically illustrated by the dotted line connecting the louvers 16 to the positioner 80. Selection means provided in the station 78 conveniently permit manual control of the positioner 80 which may be remotely located from the station 78. Since the mechanical connection of the positioner 80 and the louvers 16 typically requires those elements to be relatively adjacent one another, they typically will be remote from the station 78 which, by contrast, is typically more desirably located at the control station for the overall system. Conversely, and particularly in the normal operation of the system of the invention, the station 78 is set to operate automatically. In that instance, a transfer valve assembly in the station 78 responds to the pneumatic signal of controller 76 to effectively transfer that same signal to the positioner 80; the latter then converts the pneumatic input signal to a mechanical output, thereby to effect appropriate positioning of the louvers 16 as required by the output signal from controller 76.

In operation, each of the dampers 28 in the rooms serviced by the installation is adjusted individually by its associated thermostat 30 to attain a desired condition. There results varying supply flow rate requirements for each room, and thus for the total supply flow rate as experienced through the duct 18. That varying flow rate is sensed by sensor 64 and transmitted by transmitter 74 to the controller 76 for establishing a varying set point. The duct pressure, varying in response to the flow rate and other conditions, is sensed by sensor 60 and transmitted by transmitter 72 to controller 76 as a feedback signal. The controller 76 then produces the control signal output, proportionally and integrally related, as desired, to these input signals, and their predetermined relationship. and transferred by station 78, when set for automatic operation to actuate positioner 80 to adjust the louvers 16. As the supply air flow rate requirements decrease and the discharge pressure of the supply blower 10 begins to increase, the louvers 16 are adjusted correspondingly to reduce the output of the blower 10 and thus maintain the discharge pressure at a value related to the supply air flow rate so as to prevent surging from occurring. Similarly, as the supply air flow rate requirements increase resulting in a decrease of the discharge pressure, the louvers 16 are adjusted to a more open condition, thereby increasing the output of the blower 10 and maintaining the requisite discharge pressure to insure an adequate air flow rate to satisfy the ventilation requirements.

In the return system, the problem of surging typically is not present since the return blower 40 exhausts to atmospheric pressure. However, for maximum efficiency of the overall ventilating system, it is preferred that the return flow rate be maintained at some predetermined percentage of the supply flow rate, such as 90%. A flow rate sensor 82 responds to the return flow rate and, through transmitter 84, supplies a pneumatic signal representative thereof preferably to a proportional plus reset controller 86, as a feedback signal. As previously noted in connection with the description of transmitters 72 and 74, transmitter 84 can be tuned with respect to transmitter 72, so that a predetermined relationship between the supply and return flow rates can be readily established. Controller 86 receives as a set point the output of the supply flow rate transmitter 74 and in response to there two input signals produces a pneumatic output control signal for application to a manual-automatic control station 88. The units 82, 84, 86 and 88, as well as positioner 90, may comprise units identical to the units 64, 74, 76, 78 and 80, respectively.

Accordingly, station 88, when set for automatic operation, supplies the proportional plus reset output control signal from controller 86 to positioner 90 to adjust the louvers 46 of the return air system 40. The controller 86 thus sets the louvers 46 so as to establish the return flow rate at the desired and preferably predetermined proportion of the supply flow rate.

Typically, as noted, the return flow rate is less than the supply flow rate and thus fresh air normally is introduced into the system, as afforded by chamber 52 and louvers 54. Louvers 54 may be adjusted directly, or a positioner 92 may be provided to permit remote control. Further, automatic control of positioner 92 may be afforded such as by a further output from the proportional plus reset controller 76 or a similar controller suitably provided.

The system of the invention thus affords coordinated control of the supply and return blowers to assure maximum efficiency of operation while maintaining the requisite supply flow rates as required by ventilation requirements of the installation serviced by the system and assuring that surging cannot occur regardless of flow rate variations.

Figure 2:
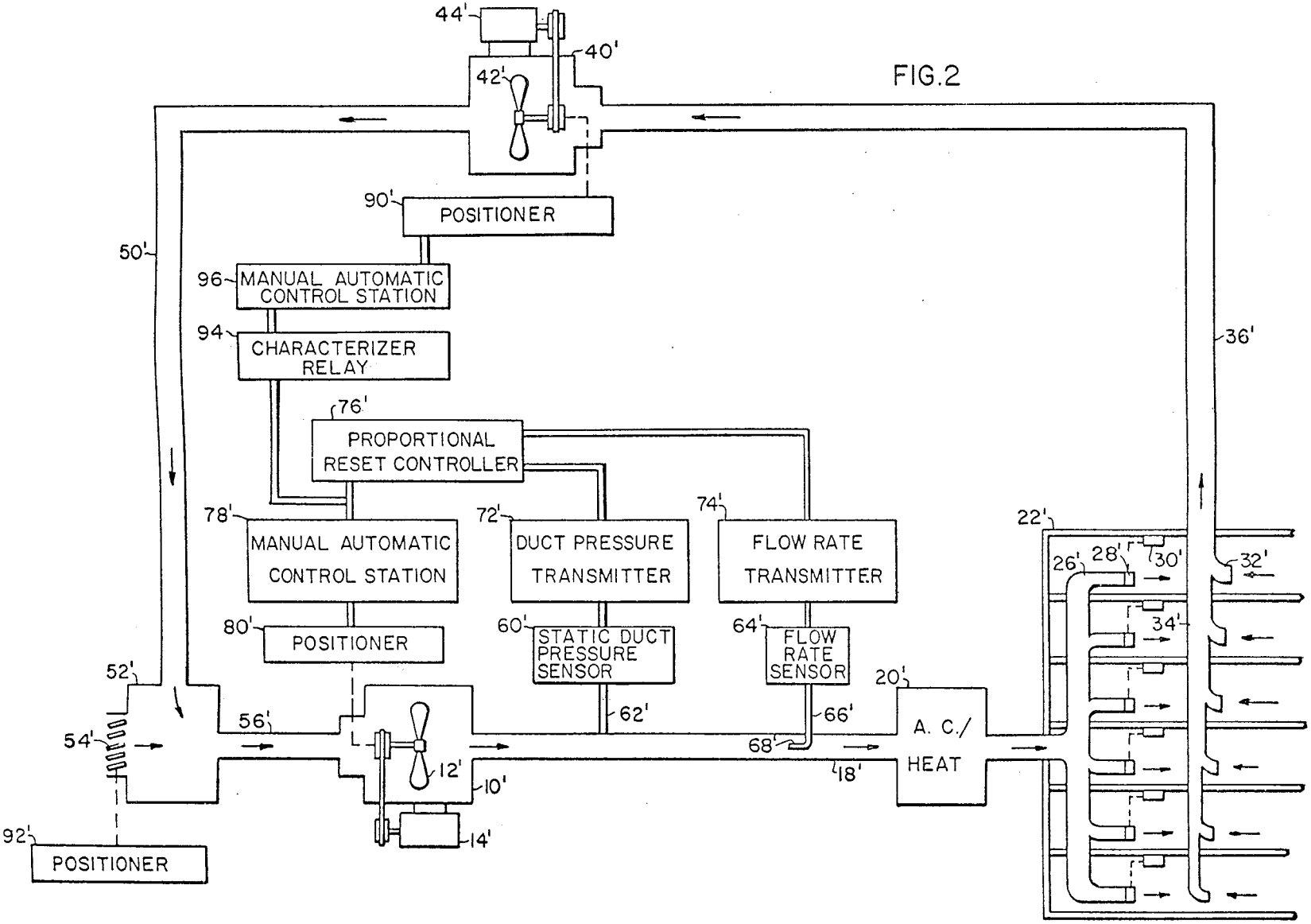
FIG. 2 comprises a block diagram of a second embodiment of the invention.

The system of FIG. 2 is substantially identical to that of FIG. 1 as to the supply and thus corresponding elements are identified by identical, but primed, numerals. A primary difference in the supply as shown in FIG. 2 is that the fan 12' of blower 10' has variable pitch blades, control of the pitch being diagrammatically illustrated by the dotted line connection from the positioner 80'. Blowers incorporating variable pitch blades of this type are commercially available and thus further details are not herein described. The return system in FIG. 2 similarly includes a return blower 40', the blades 42' of which are variable pitch as controlled by positioner 90'. The louvers in each of the air supply systems thus are eliminated in FIG. 2 as compared with FIG. 1.

In FIG. 2, the control signal for positioner 90', for controlling the pitch of the blades 42' of the return blower and thus the return flow rate, is generated by characterizer relay 94, a commercially available mechanism which may be adjusted to establish an output signal as a desired percentage of an input signal. Relay 94 receives the control output of controller 76', and thus provides an output pneumatic control signal to the manual-automatic control station 96, which is a desired proportion of the control signal for the supply blower 10'. The manual-automatic control station 96 may be similar to the station 78', and thus selectively may afford either manual control, or automatic response to the output of the characterizer relay 94 for control of the positioner 90'. Thus, in the system of FIG. 2, it is assumed that the characteristics of the return blower 40' correspond sufficiently closely to those of the supply blower 10' such that adjustment thereof in predetermined proportion to the adjustment of the supply blower achieves the desired precalibrated relationship between the supply and return flow rates.

The advantage of the system of FIG. 2 correspond to those of FIG. 1 as above described, but in addition, additional cost savings are realized in view of the simplified return portion of the control system of FIG. 2 as compared with FIG. 1. It will be apparent that the system of FIG. 1 may incorporate variable pitch blower fans as in FIG. 2 in lieu of the louver control, as shown, and that the simplified return control system of FIG. 2 may be used as well in the system of FIG. 1.

As examples of typical operating conditions and installation to which the control system of this subject invention relates, flow rates typically range from 60,000 to 100,000 cubic feet of air per minute, the return flow specified above as being 90% of the supply may, in fact, range from approximately 70% to slightly in excess of 90%. Likewise as above noted, the static pressure which is measured and corresponds to the discharge pressure or plenum chamber pressure produced by the supply blower ranges from 1 inch to 30 inches.

Numerous modifications and adaptations of the system of the invention will be apparent to those skilled in the art. It is accordingly desired that the invention be interpreted to embrace all such modifications and adaptations which fall within the true spirit and scope of the invention.

What is claimed is:

1. A blower system for a central air conditioning installation servicing a facility having variable air supply flow rate requirements in accordance with attaining desired atmospheric conditions within each portion of the facility serviced by the installation, comprising:

a supply blower, duct means connected to said supply blower for receiving and conveying an air supply flow from said supply blower to air conditioning means, the air as conditioned therein being supplied to said facility, first sensing means communicating with said duct means for sensing the air supply flow rate therewithin and producing a first pneumatic signal representative thereof, second sensing means communicating with said duct means for sensing the static duct pressure therewithin as corresponding to the discharge pressure of said supply blower and producing a second pneumatic signal representative thereof, a proportional plus reset controller, means for transmitting the first pneumatic signal to said proportional plus reset controller as a set point signal, and for transmitting the second pneumatic signal to said proportional reset controller as a feedback signal, said transmitting means including tuning means for adjusting said first and second pneumatic signals in accordance with a predetermined desired relationship of the discharge pressure of said supply blower and the supply flow rate, said proportional plus reset controller being operable to produce a pneumatic output control signal dependent on the difference between the feedback pneumatic signal and the set point pneumatic signal, and adjustment means responsive to the pneumatic output control signal of said proportional plus reset controller for adjusting the output of said supply blower to establish said desired relationship of the discharge pressure of said supply blower with respect to the supply flow rate.

2. A system as recited in claim 1, further comprising:

a return blower, means connecting said return blower to said facility for exhausting air therefrom, control means for said return blower responsive to the supply flow rate for producing a return control output related thereto for establishing a predetermined desired relationship of the return flow rate and the supply flow rate, adjustment means responsive to the return control output for adjusting the output of said return blower to attain said desired relationship of the supply and return flow rates, and return duct means connecting the output of said return blower to the input of said supply blower to return the exhausted air thereto for recirculation by the supply blower to the facility.

3. A system as recited in claim 2, further comprising:

means within said return duct means selectively adjustable for introducing a desired proportion of fresh air into the return flow of air to said supply blower.

4. A system as recited in claim 2, wherein there is further provided:

third sensing means communicating with said return duct means for sensing the return flow rate therewithin and generating a third pneumatic signal representative thereof, means for transmitting the third pneumatic signal to said return blower control means, including tuning means for adjusting said third pneumatic signal in accordance with said predetermined relationship of the supply and return flow rates, and said return blower control means comprises a further proportional reset controller receiving said first pneumatic signal from said first sensing means as a set point signal and receiving said third pneumatic signal from said transmitting means therefor means as a feedback signal and producing a further pneumatic output control signal dependent on the difference between the supply flow rate and the return flow rate as represented by said first and third pneumatic signals, respectively.

5. A system as recited in claim 2, wherein said control means for said return blower comprises a pneumatic characterizer relay responsive to the output control signal of said proportional reset controller for generating the return control output as a predetermined proportion of the supply control output.

6. A blower system for a central air conditioning installation servicing a facility having variable air supply flow rate requirements in accordance with attaining desired atmospheric conditions within each portion of the facility serviced by the installation, comprising:

a supply blower, duct means connected to said supply blower for receiving and conveying an air supply flow from said supply blower to air conditioning means, the air as conditioned therein being supplied to said facility, first sensing means communicating with said duct means for sensing the air supply flow rate therewithin and producing a first signal representative thereof, second sensing means communicating with said duct means for sensing the static duct pressure therewithin as corresponding to the discharge pressure of said supply blower and producing a second signal representative thereof, first and second transmitting means operably coupled to said first and second sensing means for transmitting the signals produced thereby, said first and second transmitting means including tuning means for adjusting said first and second signals in accordance with a predetermined desired relationship of the supply flow rate and the discharge pressure of said supply blower, a control system responsive to said supply flow rate and pressure adjusted signals to generate an output control signal, and adjustment means responsive to the output control signal for adjusting the output of said supply blower to establish said desired relationship of the discharge pressure of said supply blower with respect to the supply flow rate.

7. A system as recited in claim 6, further comprising:

a return blower, means connecting said return blower to said facility for exhausting air therefrom, return duct means connecting the output of said return blower to the input of said supply blower to return the exhausted air thereto for recirculation by the supply blower to the facility, third sensing means communicating with said return duct means for sensing the return flow rate therewithin and producing a third signal representative thereof, third transmitting means operably coupled to said third sensing means for transmitting the signal produced thereby, said third transmitting means including tuning means for adjusting said third signal in accordance with a predetermined desired relationship of the supply and return flow rates, control means for said return blower responsive to the adjusted supply flow rate and return flow rat signals for producing a return control output related thereto in accordance with said desired relationship of the return flow rate and the supply flow rate, and adjustment means responsive to the return control output for adjusting the output of said return blower to attain said desired relationship of the supply and return flow rates return duct means connecting the output of said return blower to the input of said supply blower to return the exhausted air thereto for recirculation by the supply blower to the facility.

* * * * *